US010407284B2

(12) United States Patent
Matsui

(10) Patent No.: US 10,407,284 B2
(45) Date of Patent: Sep. 10, 2019

(54) DERRICKING APPARATUS

(71) Applicant: KOBELCO CONSTRUCTION MACHINERY CO., LTD., Hiroshima-shi (JP)

(72) Inventor: Dairo Matsui, Hyogo (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 173 days.

(21) Appl. No.: 15/599,990

(22) Filed: May 19, 2017

(65) Prior Publication Data

US 2017/0341914 A1 Nov. 30, 2017

(30) Foreign Application Priority Data

May 26, 2016 (JP) ..... 2016-105598
Apr. 12, 2017 (JP) ..... 2017-078957

(51) Int. Cl.
*B66C 23/82* (2006.01)

(52) U.S. Cl.
CPC ..... *B66C 23/82* (2013.01)

(58) Field of Classification Search
CPC ..... B66C 23/34; B66C 23/344; B66C 23/346; B66C 23/82–828; B66C 23/92
See application file for complete search history.

(56) References Cited

U.S. PATENT DOCUMENTS 4,421,241 A * 12/1983 Wittman ..... B66C 23/82 212/262
5,222,613 A * 6/1993 McGhie ..... B66C 23/36 212/178
5,240,129 A * 8/1993 Schrick ..... B66C 23/82 212/175

FOREIGN PATENT DOCUMENTS

JP 2010-18355 1/2010

* cited by examiner

*Primary Examiner* — Michael R Mansen
*Assistant Examiner* — Nathaniel L Adams
(74) *Attorney, Agent, or Firm* — Oblon, McClelland, Maier & Neustadt, L.L.P.

(57) ABSTRACT

It is aimed to enable an easier attachment of a lower spreader to a machine main body. The mast 30 is tiltably attached to the machine main body 13, and operable to lie over the machine main body 13. The lower spreader retainer 40 is fixedly attached to the machine main body 13, and adapted for retaining the lower spreader 50. The connector 60 connects the mast 30 and the lower spreader 50 with each other so that the mast 30 holds the lower spreader 50. The lower spreader 50 and the lower spreader retainer 40 are arranged at a position that allows the lower spreader retainer 40 to retain the lower spreader 50 in a state where the mast 30 holding the lower spreader 50 is lowered.

8 Claims, 10 Drawing Sheets

DERRICKING APPARATUS

TECHNICAL FIELD

The present invention relates to a derricking apparatus for a construction machine.

BACKGROUND ART

Japanese Unexamined Patent Publication No. 2010-18355 discloses a conventional derricking apparatus for a crane (construction machine). The crane includes a crane main body, a mast tiltably attached to the crane main body, and a lower spreader attached to the crane main body. The crane may be disassembled when being transported or the like. For transportation or the like, the lower spreader is accommodated by the mast.

When the crane is assembled, the lower spreader is required to be attached to the crane main body. According to this technology, it is necessary for an operator to perform position adjustment of the lower spreader to the crane main body by hands (i.e., manual operation) when assembling the crane. Therefore, it takes time and effort to attach the lower spreader to the came body.

SUMMARY OF INVENTION

An object of the present invention is to provide a derricking apparatus which enables an easier attachment of a lower spreader to a machine main body.

Provided is a derricking apparatus to be mounted on a construction machine including a machine main body and a tiltable member tiltably supported to the machine main body. The derricking apparatus is adapted for raising and lowering the tiltable member. The derricking apparatus includes a mast, a lower spreader, a lower spreader retainer, and a connector. The mast is attached to the machine main body tiltably about a predetermined axis, and linked with the tiltable member. The mast is operable to lie over the machine main body. The lower spreader retainer is fixedly attached to the machine main body, and adapted for retaining the lower spreader linked with the mast via a wire rope. The connector connects the mast and the lower spreader with each other so that the mast holds the lower spreader. The connector connects the mast and the lower spreader with each other at a position that allows the lower spreader retainer to retain the lower spreader when the mast holding the lower spreader is lowered to lie over the machine main body.

This and other objects, features and advantages of the present invention will become more apparent upon reading the following detailed description along with the accompanying drawings.

DESCRIPTION OF EMBODIMENTS

Figure 1:
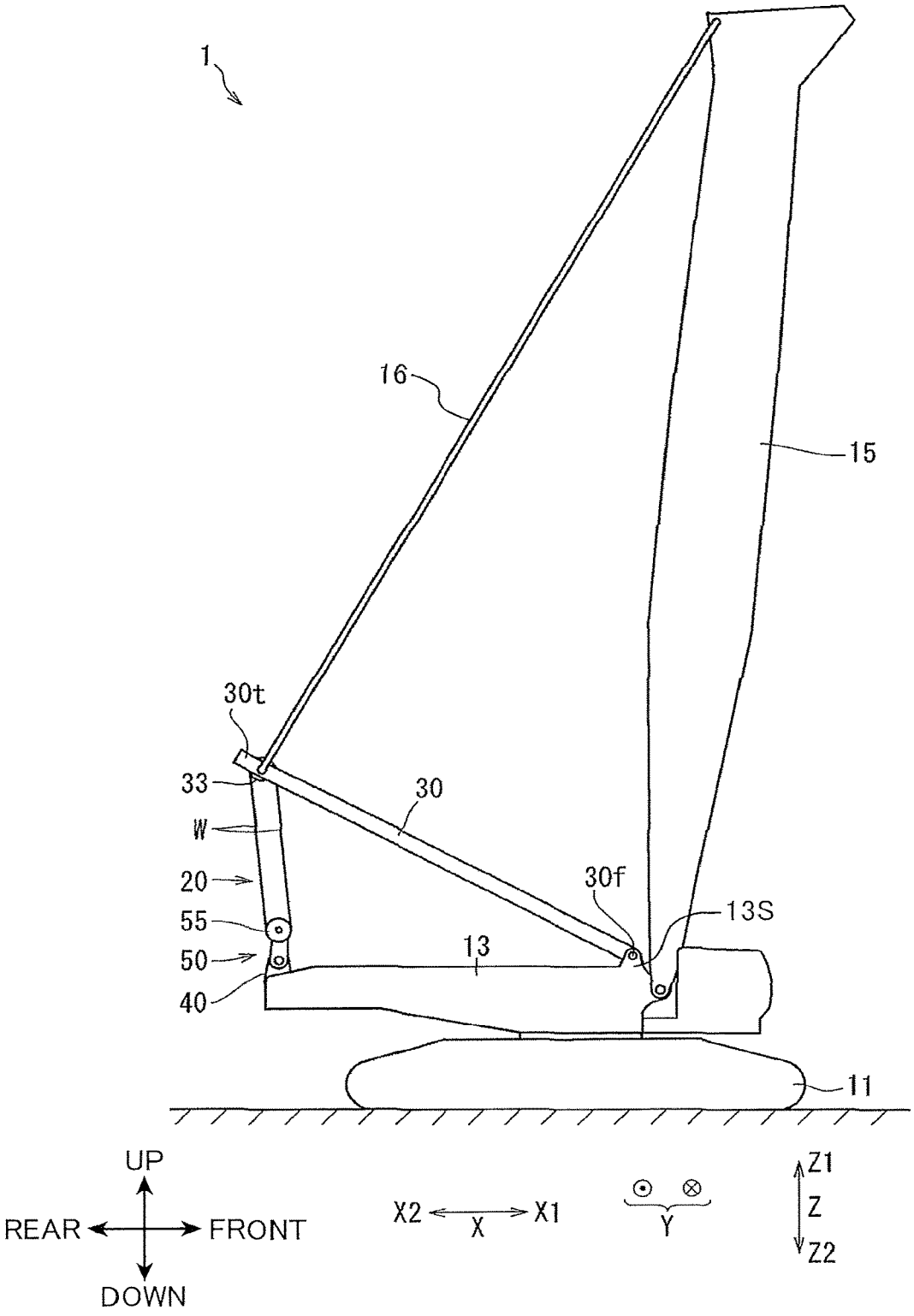
FIG. 1 is a side view of a construction machine according to an embodiment of the present invention.

Hereinafter, an embodiment of the present invention will be described with reference to the accompanying drawings. It should be noted that the following description of the embodiment substantially shows only a preferable example of the present invention, and does not intend to delimit the present invention and an applicable or usable range of the present invention. In respective drawings, upward and downward directions, frontward and rearward directions, and rightward and leftward directions are indicated by arrows. Upward and downward, and other directions to be described below respectively correspond to the aforementioned directions indicated by the arrows but some exceptions. A crane (construction machine) 1 including a derricking apparatus 20 will be described with reference to FIGS. 1 to 8.

The crane 1 is a construction machine, such as a mobile crane, to perform an operation using a boom (tiltable member) 15. The crane 1 includes a lower travelling body 11, a crane main body (machine main body) 13, the boom 15, a guy line 16, and a derricking apparatus 20. The lower travelling body 11 causes the crane 1 to move.

Figure 4:
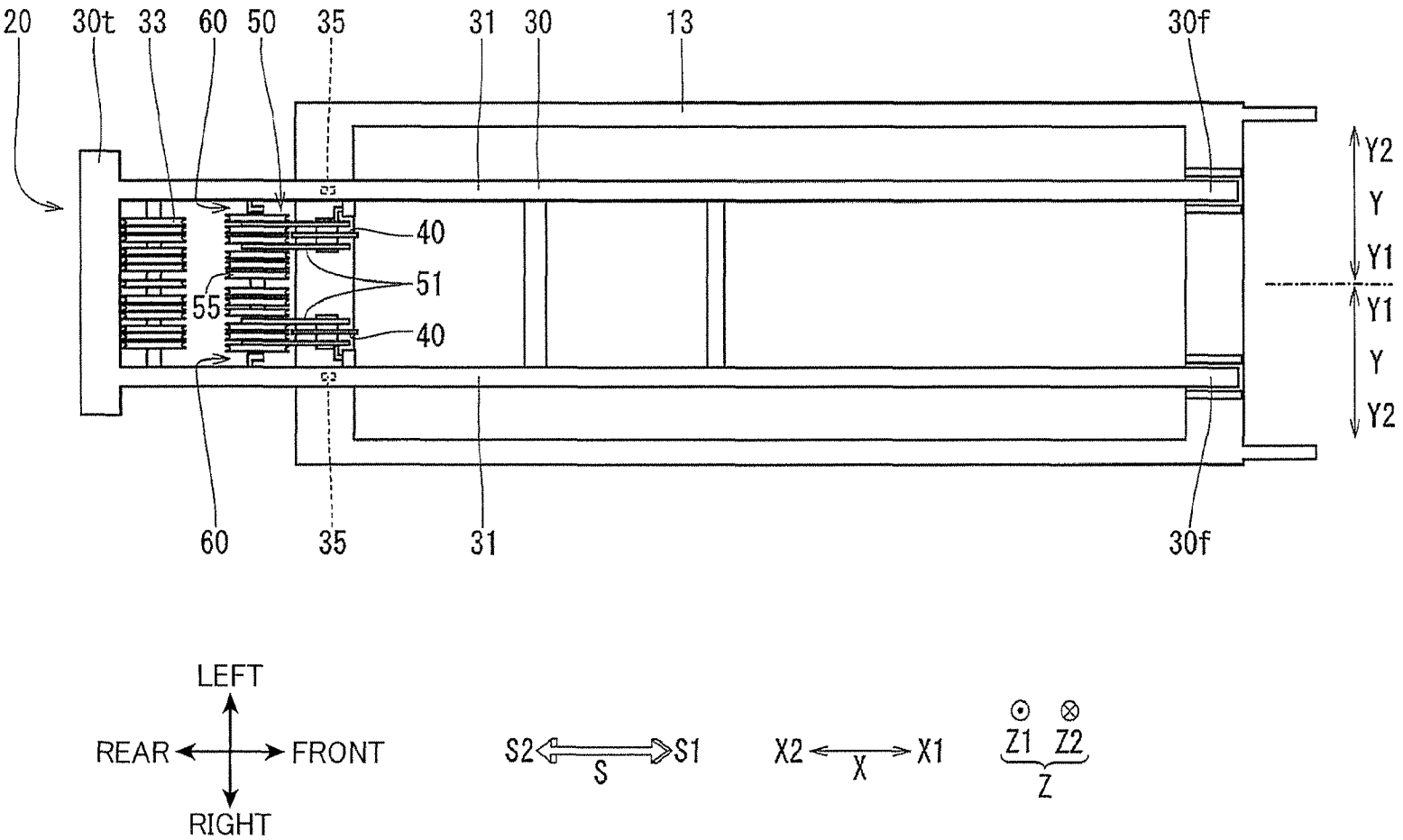
FIG. 4 is a plan view of the derricking apparatus illustrated in FIG. 3.

The crane main body 13 is mounted on the lower travelling body 11 slewably thereover. The crane main body 13 is connected with a proximal end of the boom 15, and provided with a pair of lower spreader retainers 40. Longitudinal directions of the crane main body 13 are defined as "frontward and rearward directions (X)". The frontward and rearward directions include a direction defined as a "frontward direction (X1)" from each of the lower spreader retainers 40 to the proximal end of the boom 15, and another direction defined as a "rearward direction (X2)" that is opposite to the frontward direction (X1). Further, horizontal directions perpendicularly intersecting the frontward and rearward directions are defined as "lateral directions (Y) (rightward and leftward directions)". As shown in FIG. 4, the lateral directions include a direction defined as a "laterally inward direction (Y1)" from a lateral end to a lateral center of the crane main body 13, and another direction defined as a "laterally outward direction (Y2)" from the lateral center to the lateral end of the crane main body 13, the laterally outward direction (Y2) being opposite to the laterally inward direction (Y1). As shown in FIG. 1, vertical directions (Z) include a direction defined as an "upward direction (Z1)" from the lower travelling body 11 to the crane main body 13, and another direction defined as a "downward direction (Z2)" that is opposite to the upward direction (Z1).

The boom 15 is tiltably mounted on the crane main body 13. The boom 15 is a tiltable member for hoisting an unillustrated load.

Figure 2:
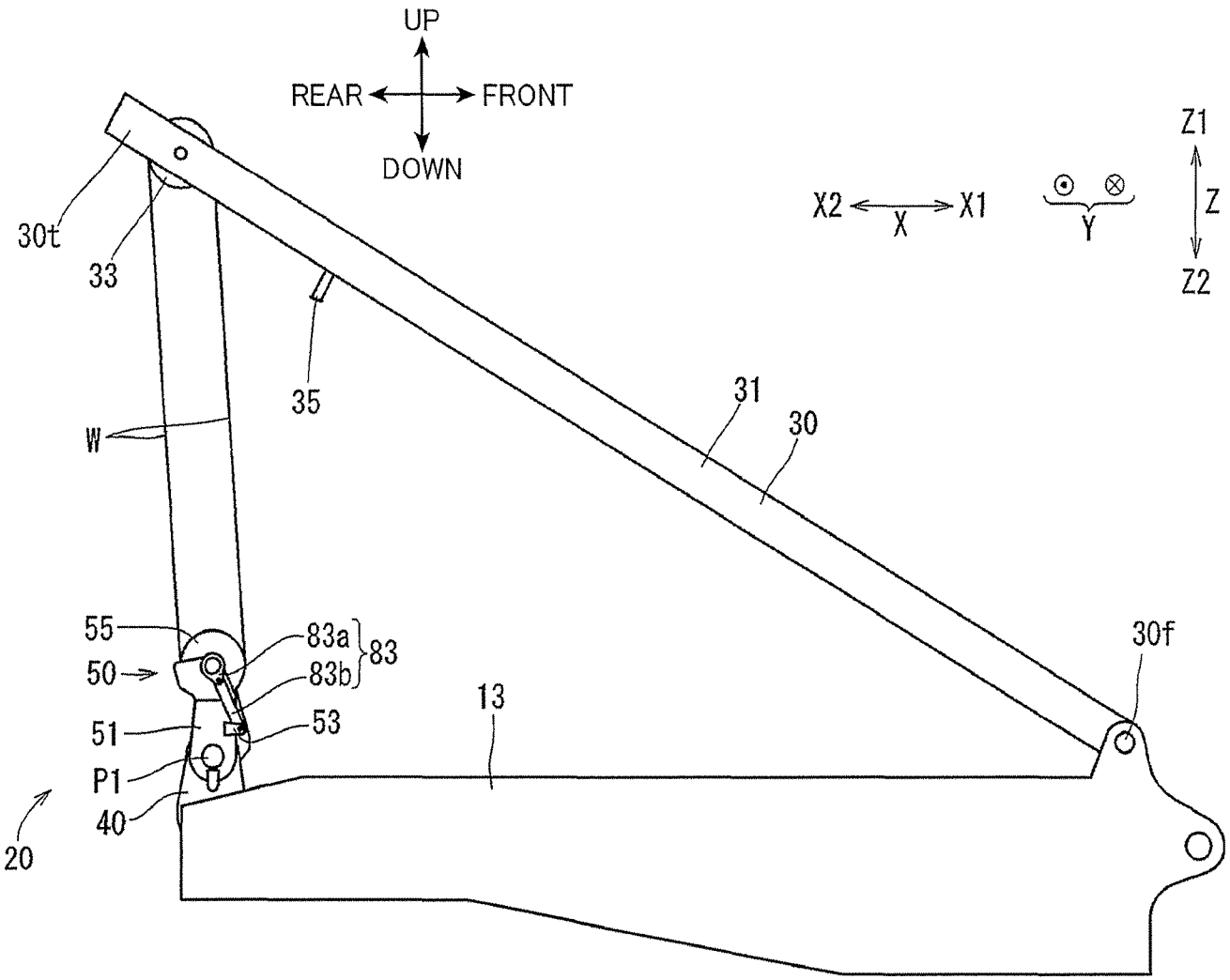
FIG. 2 is a side view illustrating a derricking apparatus of the construction machine illustrated in FIG. 1.

The derricking apparatus 20 is mounted on the crane main body 13 and adapted for raising and lowering the boom 15. As illustrated in FIG. 2, the derricking apparatus 20 includes a mast 30, the lower spreader retainers 40, a lower spreader 50, and a pair of connectors 60 shown in FIG. 3. The derricking apparatus 20 has a mechanism (referred to as a "lower spreader attaching and detaching mechanism") configured to allow the lower spreader 50 to be easily attached to and detached from each of the lower spreader retainers 40 and the mast 30.

Figure 3:
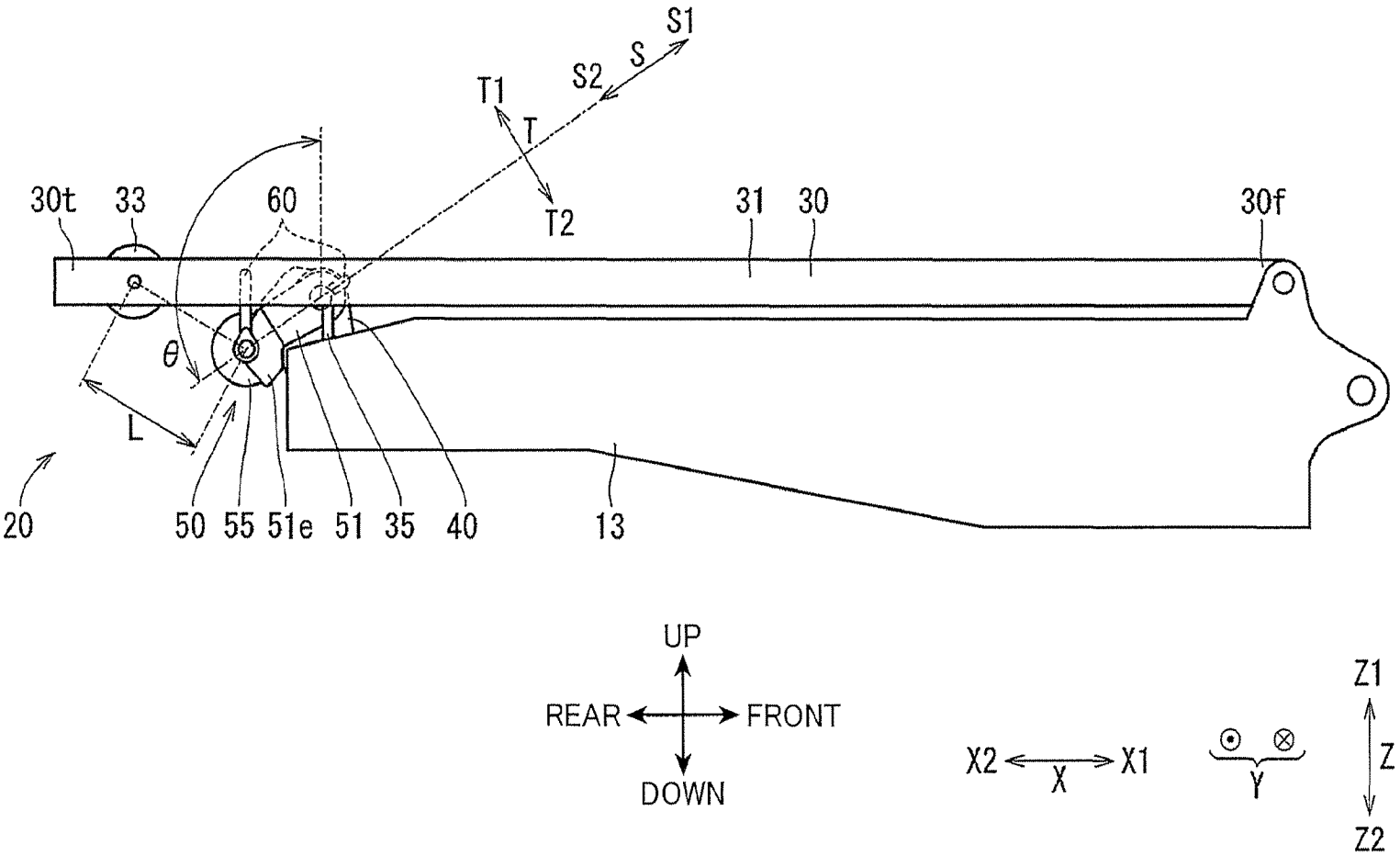
FIG. 3 is a side view illustrating the derricking apparatus whose mast is in a lowered state in the construction machine shown in FIG. 1.

The mast 30 is attached to the crane main body 13 shown in FIG. 2 tiltably (pivotally) about a predetermined axis, and linked with the boom 15. The crane main body 13 includes a mast support 13S. The mast support 13S is arranged at a front end of the crane main body 13. The mast 30 has a proximal end (mast proximal end 30*f*) attached to the mast support 13S. It should be noted that the word "end" means an "end edge" and a "portion near the end edge" (hereinafter, this definition is applied as well). As shown in FIG. 1, the mast 30 is located behind the boom 15 on the crane main body 13. The guy line 16 has one end connected to a distal end (mast distal end 30*t*) of the mast 30 and the other end connected to a distal end of the boom 15. Longitudinal directions of the mast 30 along which an axis of the mast 30 extends are defined as "mast axial directions". The mast axial directions include a direction defined as a "to-proximal-end direction" from the mast distal end 30*f* to the mast proximal end 30*f*, and another direction defined as a "to-distal-end direction" that is opposite to the to-proximal-end direction. As shown in FIG. 4, the mast 30 is laterally symmetrical with respect to the axis (in the rightward and leftward directions). The laterally symmetric configuration is applied to the lower spreader retainer 40, the lower spreader 50, and the connector 60. As shown in FIG. 3, the mast 30 can be placed in a "lowered state". The lowered state means a state where the mast 30 is lowered to longitudinally lie over the crane main body 13 (in the frontward and rearward directions). In the lowered state, the mast axial directions are along or substantially along the frontward and rearward directions. The mast 30 is made into a box-shape, and thus is called as a box mast. As shown in FIG. 4, the mast 30 includes a pair of main members 31, a plurality of upper sheaves 33, and a pair of mast support members 35 (see FIG. 2).

Each in the pair of main members 31 has a pillar (bar) shape, and extends in the mast axial directions or substantially mast axial directions. The pair of main members 31 are connected with each other while laterally defining a space therebetween, and tiltably attached to the crane main body 13.

Each of the upper sheaves (upper spreader sheaves) 33 is in the form of a pulley having a circumferential surface on which a wire rope W (see FIG. 2) is wound. The upper sheaves 33 are laterally juxtaposed. The upper sheaves 33 are provided at the mast distal end 30*t*, and rotatably attached to the main members 31. The wire rope W shown in FIG. 2 runs through the upper sheaves 33 and lower sheaves 55 of the lower spreader 50 therebetween. The wire rope W is wound up and out by an unillustrated winch to raise and lower the mast 30 with respect to the crane main body 13. Consequently, the boom 15 (see FIG. 1) linked with the mast 30 rises and lowers with respect to the crane main body 13.

The pair of mast support members 35 respectively protrude from the pair of main members 31. As shown in FIG. 3, when coming into contact with the crane main body 13 in the lowered state of the mast 30, the pair of mast support members 35 allow the mast 30 to be held on the crane main body 13. The pair of mast support members 35 protrude downward from the main members 31 in the lowered state of the mast 30.

As shown in FIG. 2, the lower spreader retainer 40 retains the lower spreader 50 to the crane main body 13. The lower spreader retainer 40 is fixedly attached to a rear end of the crane main body 13. The lower spreader retainer 40 protrudes upward from a top surface of the crane main body 13. The lower spreader retainer 40 permits the lower spreader 50 to be linked with the mast 30 via the wire rope W while retaining the lower spreader 50.

Figure 6:
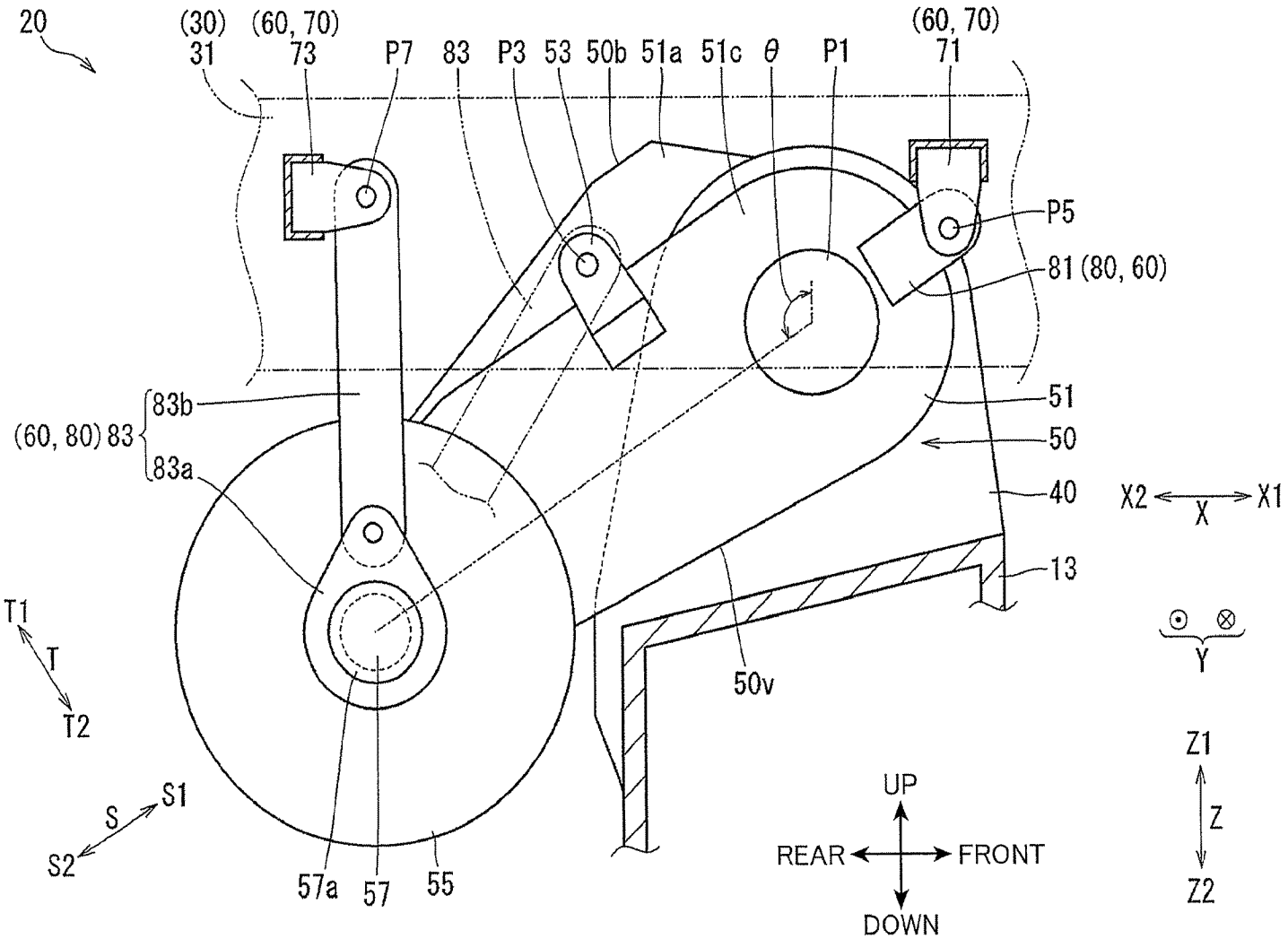
FIG. 6 is a cross sectional view of the lower spreader of the derricking apparatus illustrated in FIG. 3 and its periphery, viewed in the directions of arrows F6 shown in FIG. 5.
Figure 8:
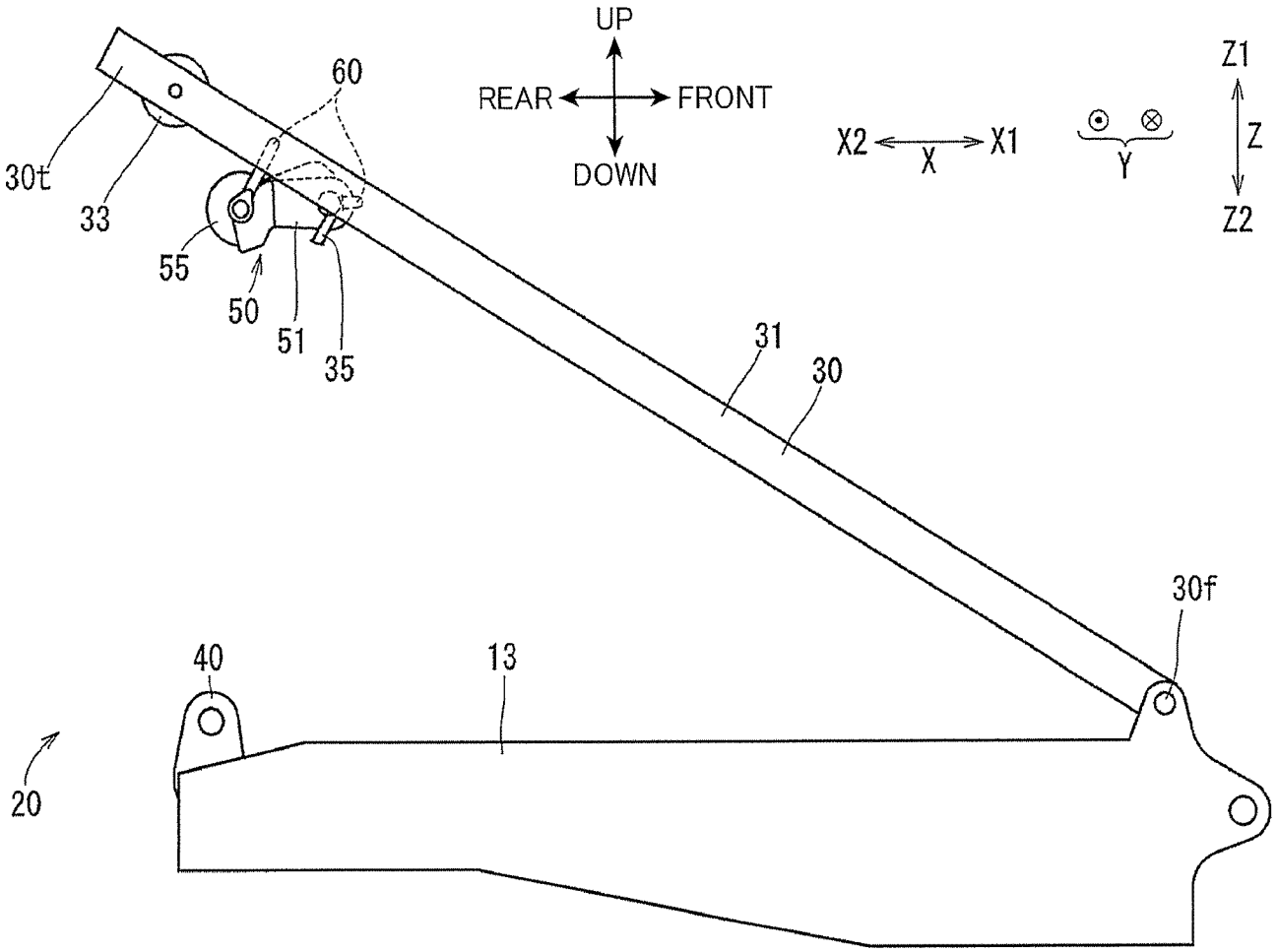
FIG. 8 is a side view illustrating the derricking apparatus whose mast is in a raised state in the construction machine illustrated in FIG. 1, the lower spreader being attached to the mast.

As shown in FIGS. 2 and 8, the lower spreader 50 is attachable to and detachable from the lower spreader retainer 40. The lower spreader 50 is attachable to and detachable from the mast 30 as well. As shown in FIG. 1, the lower spreader 50 is attached to the lower spreader retainer 40 (i.e., is placed in a to-machine-attachment state) when the crane 1 is put in operation (i.e., crane operation state). After being attached to the machine main body 13, the lower spreader 50 is linked with the mast 30 via the wire rope W to raise and lower the boom 15. Furthermore, the lower spreader 50 is attached to the mast 30, for example, when the crane 1 is transported in a dissembled state, or when the crane 1 is put in assembling and disassembling (hereinafter, referred to as "for transportation or the like"). As shown in FIG. 3, for transportation or the like, the lower spreader 50 can be put in an "accommodation state" where the lower spreader 50 is attached to and held by the mast 30. The accommodation state means a state where the lower spreader 50 is accommodated by or attached to the mast 30 after the mast 30 and the lower spreader 50 are connected with each other by the connector 60. As shown in FIG. 6, the lower spreader 50 has a holder frame 51, a pair of connecting member holders 53, a plurality of lower sheaves 55, and a lower sheave center shaft 57.

Figure 5:
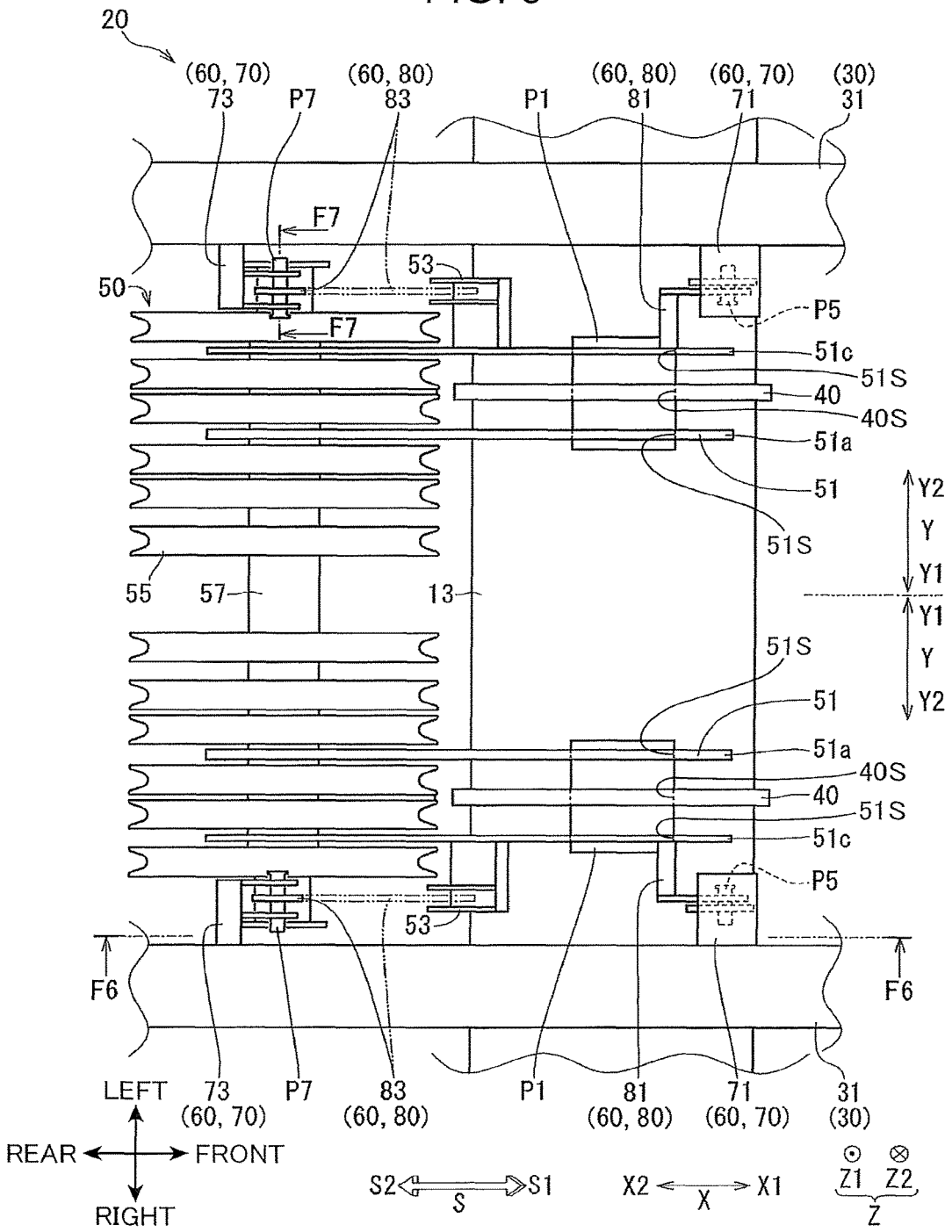
FIG. 5 is an enlarged plan view showing a lower spreader of the derricking apparatus illustrated in FIG. 3 and its periphery.

Directions in connection with the lower spreader 50 will be defined as follows. In a lateral view, directions of a line passing through a center of a lower spreader attachment pin P1 and a center of the lower sheave center shaft 57 are defined as "lower spreader axial directions (S)" (FIG. 6). As shown in FIG. 5, the lower spreader axial directions perpendicularly intersect the lateral directions. As shown in FIG. 6, the lower spreader axial directions include a direction defined as a "to-lower-spreader-proximal-end direction (S1)" from the center of the lower sheave center shaft 57 to the center of the lower spreader attachment pin P1 (i.e., toward a lower spreader proximal end), and another direction defined as a "to-lower-spreader-distal-end direction (S2)" that is opposite to the to-lower-spreader-proximal-end direction (S1). Directions perpendicularly intersecting the lateral directions and the lower spreader axial directions are defined as "lower-spreader-axis-perpendicular-intersection directions (T)" (FIG. 6). The lower-spreader-axis-perpendicular-intersection directions include a direction defined as a "to-lower-spreader-back-surface direction (T1)" from a ventral surface 50*v* to a back surface 50*b* of the lower spreader 50, and another direction defined as a "to-lower-spreader-ventral-surface direction (T2)" that is opposite to the to-lower-spreader-back-surface direction (T1). When the lower spreader axial directions are along the frontward and rearward directions (unillustrated), the back surface 50*b* is on a top of the lower spreader 50, and the ventral surface 50*v* is on a bottom of the lower spreader 50. In order to determine an orientation of the lower spreader 50, a tilt angle θ is defined. The tilt angle θ indicates what extent the lower spreader 50 is tilted rearward from a position where the lower spreader 50 stands upward (upright) to the lower spreader retainer 40 (FIG. 2). In the lateral view, the tilt angle θ equals to "180°–(an angle between the vertical directions and the lower-spreader-axial directions)".

The holder frame 51 is attachable to and detachable from the lower spreader retainer 40 by the lower spreader attachment pin (connection pin) P1. The lower spreader retainer 40 is formed with a body-side hole 40S (FIG. 5). The holder frame 51 of the lower spreader 50 is formed with a spreader-side hole 51S (FIG. 5). The lower spreader attachment pin P1 is inserted through the body-side hole 41S and the spreader-side hole 51S to connect the lower spreader retainer 40 and the lower spreader 50 with each other. The holder frame 51 is rotatable about an axis of the lower spreader attachment pin P1 with respect to the lower spreader retainer 40. The holder frame 51 has a rotational axis extending in parallel to the lateral directions with respect to the lower spreader retainer 40 (other rotational axes to be described below extend in the same directions as well). As shown in FIG. 5, the holder frame 51 includes a plurality of plates. For example, the holder frame 51 includes a pair of plates 51*a* (i.e., two plates in total on laterally opposite sides of the holder frame 51), a pair of outer plates 51*c* (i.e., two plates in total arranged in the same manner), and a pair of sheave outer plates 51*e* (see FIG. 3). Each of the inner plates 51*a* and outer plates 51*c* extends in the lower-spreader-axial directions (S). The inner plate 51*a* and the outer plate 51*c* are arranged to sandwich the lower spreader retainer 40 therebetween. The outer plate 51*c* is arranged at a laterally outer position than the inner plate 51*a*. Each in the pair of the sheave outer plates 51*e* shown in FIG. 3 is arranged at a laterally outer position than the lower sheaves 55 (see FIG. 5), and covers a part of the lower sheaves 55.

As shown in FIG. 6, each in the pair of connecting member holders 53 holds a lower sheave-side connecting member 83 to be described later in cooperation with the holder frame 51. The connecting member holder 53 is fixedly provided at the holder frame 51. Specifically, the pair of connecting member holders 53 are respectively attached to the pair of outer plates 51*c*. More specifically, the connecting member holder 53 is fixedly attached to a center portion of the corresponding outer plate 51*c* in the lower-spreader-axial directions. The connecting member holder 53 protrudes laterally outward from the outer plate 51*c* as shown in FIG. 5, and in the to-lower-spreader-back-surface direction (T1) than the outer plate 51*c* as shown in FIG. 6.

Each of the lower sheaves 55 is in the form of a pulley having a circumferential surface on which the wire rope W (see FIG. 2) is wound. As shown in FIG. 5, the lower sheaves 55 are laterally juxtaposed. The lower sheaves 55 are rotatably linked with the holder frame 51 via the lower sheave center shaft 57.

The lower sheave center shaft 57 is supported by the holder frame 51, and rotatably supports the lower sheaves 55. The lower sheave center shaft 57 is arranged along a rotational axis of the lower sheaves 55. The lower sheave center shaft 57 includes a laterally extending rod-like member (pin), and a shaft outer plate 57*a* (see FIG. 7) which is attached to a laterally outer end of the rod-like member.

As shown in FIG. 6, the laterally provided pair of connectors 60 connect the mast 30 and the lower spreader 50 with each other to permit the lower spreader 50 to be in the accommodation state where the lower spreader 50 is attached to and held by the mast 30. Hereinafter, constituent elements of each in the pair of the connector 60 will be described in connection with the accommodation state of the lower spreader 50. The connector 60 includes a mast-side connecting section 70 and a lower spreader-side connecting section 80.

The mast-side connecting section 70 is provided at the mast 30. Specifically, the mast-side connecting section 70 is fixedly attached to the main member 31. The mast-side connecting section 70 includes a mast proximal end-side connecting member 71 and a mast distal end-side connecting member (mast-side connecting member) 73. The mast proximal end-side connecting member 71 has one portion protruding laterally inward from the main member 31 as shown in FIG. 5, and another portion extending downward from the one portion (shown in the cross sectional view of FIG. 6 as well) as shown in FIG. 6. The mast distal end-side connecting member 73 is arranged closer to the mast distal end 30*t* than the mast proximal end-side connecting member 71. The mast distal end-side connecting member 73 has one portion protruding laterally inward from the main member 31 as shown in FIG. 5, and another portion extending from the one portion (shown in the cross sectional view of FIG. 6 as well) toward the mast proximal end 30*f* as shown in FIG. 6.

The lower spreader-side connecting section 80 is provided in the lower spreader 50. The lower spreader-side connecting section 80 includes a frame-side connecting member 81, the lower sheave-side connecting member 83, and a spacer 85 (see FIG. 7).

The frame-side connecting member 81 connects the holder frame 51 and the mast 30 with each other. The frame-side connecting member 81 is attached to the mast proximal-side connecting member 71 by a frame-side connection pin P5. Further, the frame-side connecting member 81 is provided at the holder frame 51. Specifically, the frame-side connecting member 81 is fixedly attached to the outer plate 51*c*. The frame-side connecting member 81 is arranged closer to the lower spreader proximal end on one side of the gravity center of the lower spreader 50 that is opposite to the other side where the lower sheaves 55 lie. The frame-side connecting member 81 is arranged on one end of the outer plate 51*c* that is closer to the lower spreader proximal end. The frame-side connecting member 81 protrudes laterally outward from the outer plate 51*c* as shown in FIG. 5, and further extends out from the holder frame 51 in the to-lower-spreader-proximal-end direction (S1) as shown in FIG. 6.

The lower sheave-side connecting member 83 connects the mast 30 and a specified portion with each other, the specified portion being closer to the lower sheave 55 than the gravity center of the lower spreader 50. The lower sheave-side connecting member 83 links the lower sheave center shaft 57 with the mast 30. The lower sheave-side connecting member 83 is attached to the mast distal-side connecting member 73 by a lower sheave-side connection pin P7. The lower sheave-side connecting member 83 is configured in such a manner that the lower sheave 55 is arranged at a lower position than the lower sheave-side connection pin P7. The lower sheave-side connecting member 83, for example, has a longitudinal dimension (in the upward direction illustrated in FIG. 6) that is substantially the same as a diameter of the lower sheave 55. The lower sheave-side connecting member 83 includes a shaft link part 83*a* and an extension link part 83*b*.

Figure 7:
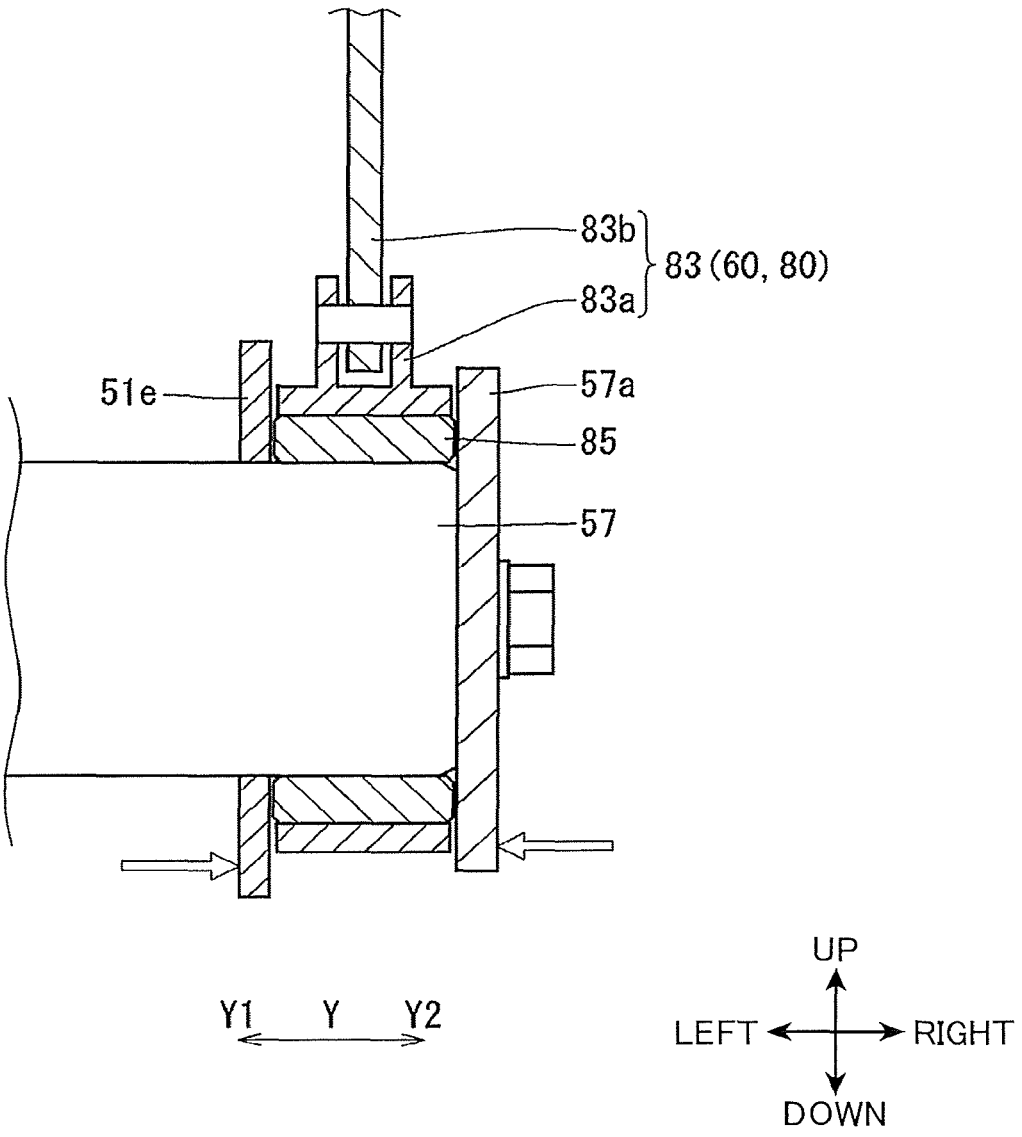
FIG. 7 is a cross sectional view of a lower sheave center shaft of the derricking apparatus illustrated in FIG. 5 and its periphery, viewed in the forward and backward directions along the arrows F7 shown in FIG. 5.

The shaft link part 83*a* is rotatably connected to the lower sheave center shaft 57. The shaft link part 83*a* extends radially outward from the lower sheave center shaft 57. The shaft link part 83*a* is arranged at a laterally outer position than the lower sheave 55 (see FIG. 5). As shown in FIG. 7, the shaft link part 83*a* is placed in a (lateral) space between the sheave outer plate 51*e* and the shaft outer plate 57*a*.

The extension link part 83*b* has a bar-like shape as shown in FIG. 6. The extension link part 83*b* has one longitudinal end pivotally connected to the shaft link part 83*a*, and the other longitudinal end attached to the mast distal-side connecting member 73 by the lower sheave-side connection pin P7.

The spacer 85 ensures smooth rotation of the shaft link part 83*a* (i.e., the lower sheave-side connecting member 83) about the lower sheave center shaft 57 shown in FIG. 7. The spacer 85 is placed in the (lateral) space between the sheave outer plate 51*e* and the shaft outer plate 57*a*. The spacer 85 is placed between the shaft link part 83*a* and the lower sheave center shaft 57 (in the radial direction of the lower sheave center shaft 57). The spacer 85 has a larger lateral dimension than the shaft link part 83*a*. When the sheave outer plate 51*e* and the shaft outer plate 57*a* are applied with opposite lateral forces toward the shaft link part 83*a*, the spacer 85 comes into contact with the sheave outer plate 51*e* and the shaft outer plate 57*a*. In this manner, the spacer 85 prevents the shaft link part 83*a* from coming into contact with the sheave outer plate 51*e* and the shaft outer plate 57. Accordingly, the spacer 85 ensures the smooth rotation of the lower sheave-side connecting member 83 about the lower sheave center shaft 57.

(Manipulation of Derricking Apparatus 20)

Manipulation of the derricking apparatus 20 illustrated in FIG. 2 will be described below. It should be noted that the tilt angle θ (see FIG. 3) of the lower spreader 50 is set at approximately 0° when the crane 1 is put in operation (see FIG. 1). The wire rope W extends through the upper sheave 33 and the lower sheave 55. The crane 1 is put in a disassembled state for transportation thereof. As shown in FIG. 3, when the crane 1 is transported, the mast 30 is transported integrally with the lower spreader 50 in the state where the lower spreader 50 is accommodated by the mast 30. In this configuration, when the crane 1 is dissembled, it is unnecessary to remove the wire rope W (see FIG. 1) from the upper sheave 33 and the lower sheave 55. Also, when the crane 1 is assembled, it is unnecessary to wind the wire W on the upper sheave 33 and the lower sheave 55.

When the crane 1 is assembled, the derricking apparatus 20 is mounted on the crane main body 13 in accordance with the following manipulation sequence.

[A] The mast proximal end 30*f* shown in FIG. 8 is attached to the crane main body 13. The attachment is performed in a state where the mast proximal end 30*f* is located in front of the mast distal end 30*t*. In this case, the lower spreader 50 is in the accommodation state where the lower spreader 50 is accommodated by the mast 30.

[B] Then, the mast 30 is lowered so that the mast distal end 30*t* moves rearward. As a result, as shown in FIG. 3, the mast 30 comes into the lowered state, and the lower spreader 50 is put in the accommodation state (hereinafter, referred to as "lowered and accommodated state" as well).

[C] Next, the lower spreader 50 (i.e., the holder frame 51) is attached to the lower spreader retainer 40 by the lower spreader attachment pin P1 illustrated in FIG. 6.

[D] Further, the lower spreader 50 is detached from the mast 30. Specifically, the frame-side connection pin P5 and the lower sheave-side connection pin P7 are displaced from the connector 60.

[E] After that, the lower sheave-side connecting member 83 is held by the holder frame 51. Specifically, the extension link part 83*b* is attached to the connecting member holder 53 by a connecting member holding pin P3 (e.g., the lower sheave-side connection pin P7). In this case, in the lateral view, the connecting member holder 53 and the extension link part 83*b* are arranged at inner positions than an outline of the inner plate 51*a*.

[F] Subsequently, as shown in FIG. 2, the mast 30 is raised so that the mast distal end 30*t* moves upward. Also, the lower spreader 50 is raised so that the tilting angle θ (see FIG. 3) reaches approximately 0°. Consequently, the crane 1 is set in a operably standby state as illustrated in FIG. 1.

When the crane 1 is disassembled, the above-described manipulation sequence for the assembling of the crane 1 should be performed in the opposite order to dismount the derricking apparatus 20 from the crane main body 13.

(Arrangement of Lower Spreader 50).

As shown in FIG. 6, the tilt angle θ is larger than 90° when the mast 30 lies in the lowered state and the lower spreader 50 is in the accommodation state (i.e., in the lowered and accommodated state). In this case, the lower spreader axial direction (S) and the front and rear direction define an inclined angle therebetween in such a manner that the lower sheave 55 is located at a lower position than the holder frame 51. In the lowered and accommodated state, the lower sheave center shaft 57 is located behind the came main body 13. Specifically, the lower sheave 55 is arranged at such a position as to allow a part of an outer circumferential edge portion thereof that is closest to the crane main body 13 to be located behind the crane main body 13 (see FIG. 6).

In the lowered and accommodated state, the lower spreader 50 is arranged at a position (predetermined attachment position) where the lower spreader 50 is attachable to and detachable from the lower spreader retainer 40. In other words, the position where the connector 60 connects the mast 30 and the spreader 50 with each other allows the lower spreader retainer 40 to retain the lower spreader 50 when the mast 30 holding the lower spreader 50 is lowered to lie over the crane main body 13. Also, in the accommodation state, the lower spreader 50 is held by the mast 30 via the connector 60, not via the wire rope W. In the lowered and accommodated state, the position of the body-side hole 40S of the lower spreader retainer 40 (substantially) laterally (in a direction parallel to the axis of the mast 30, i.e., in an insertion direction of the lower spreader attachment pin P1) agrees with the position of the spreader-side hole 51S of the holder frame 51 in the lower spreader 50. In this case, the lower spreader attachment pin P1 is engageable through the body-side hole 40S of the lower spread retainer 40 and the spreader-side hole 51S of the holder frame 51. When the crane 1 is assembled and the mast 30 lies in the lowered state in [B], the lower spreader 50 automatically reaches the predetermined attachment position. Thus, when performing placement of the lower spreader connection P1 in [C], an operator is not required to manually adjust the position (perform position adjustment) of the lower spreader 50 to the position of the lower spreader retainer 40.

In the lowered and accommodated state, the lower spreader 50 is arranged at such a position that, after getting on a top of the crane main body 13, the operator can easily perform placement and displacement of the lower sheave-side connection pin P7 (see FIG. 6) thereover. In the lowered and accommodated state, the lower spreader 50 is arranged at such a position as to ensure a sufficient space between the two main members 31 to perform placement and displacement of the lower sheave-side connection pin P7 in [D].

Specifically, a connection position of the lower sheave-side connecting member 83 to the mast 30 (i.e., the position of the lower sheave-side connection pin P7) is higher than the lower sheave 55. For example, an upper end of the lower sheave 55 is located at a lower position than a lower end of the main member 31.

In the lowered and accommodated state, the lower spreader 50 is arranged at such a position as to ensure a distance L shown in FIG. 3. The distance L is defined between the rotational axis of the upper sheave 33 (i.e., the rotational axis with respect to the main member 31) and a rotational axis of the lower sheave 55 (i.e., rotational axis with respect to the holder frame 51). The distance L is required to ensure a predetermined extent or greater in order to suppress slack of the wire rope W between the upper sheave 33 and the lower sheave 55. Specifically, the wire rope W is not fully wound up, when the mast 30 is lowered to lie in the lowered and accommodated state while keeping the wire rope W extending through the upper sheave 33 and the lower sheave 55. Therefore, there is a possibility that the wire rope W slacks between the upper sheave 33 and the lower sheave 55, and loosens out from at least one of the upper sheave 33 and the lower sheave 55. In order to suppress the slack and sufficiently avoid the loosing out, the distance L is required to ensure the predetermined extent or greater. Hence, in the lowered and accommodated state, the rotational axis of the lower sheave 55 is located at a lower position than the rotational axis of the upper sheave 33. For example, the rotational axis of the lower sheave 55 is located at a lower position than the main member 31. As shown in FIG. 6, for example, the rotational axis of the lower sheave 55 is located at a lower position than the center of the lower spreader attachment pin P1. The center of the lower spreader attachment pin P1 is located at a position that is lower than a top of the main member 31 and higher than a bottom thereof, i.e., located at a position between the top and the bottom of the main member 31.

Figure 9:
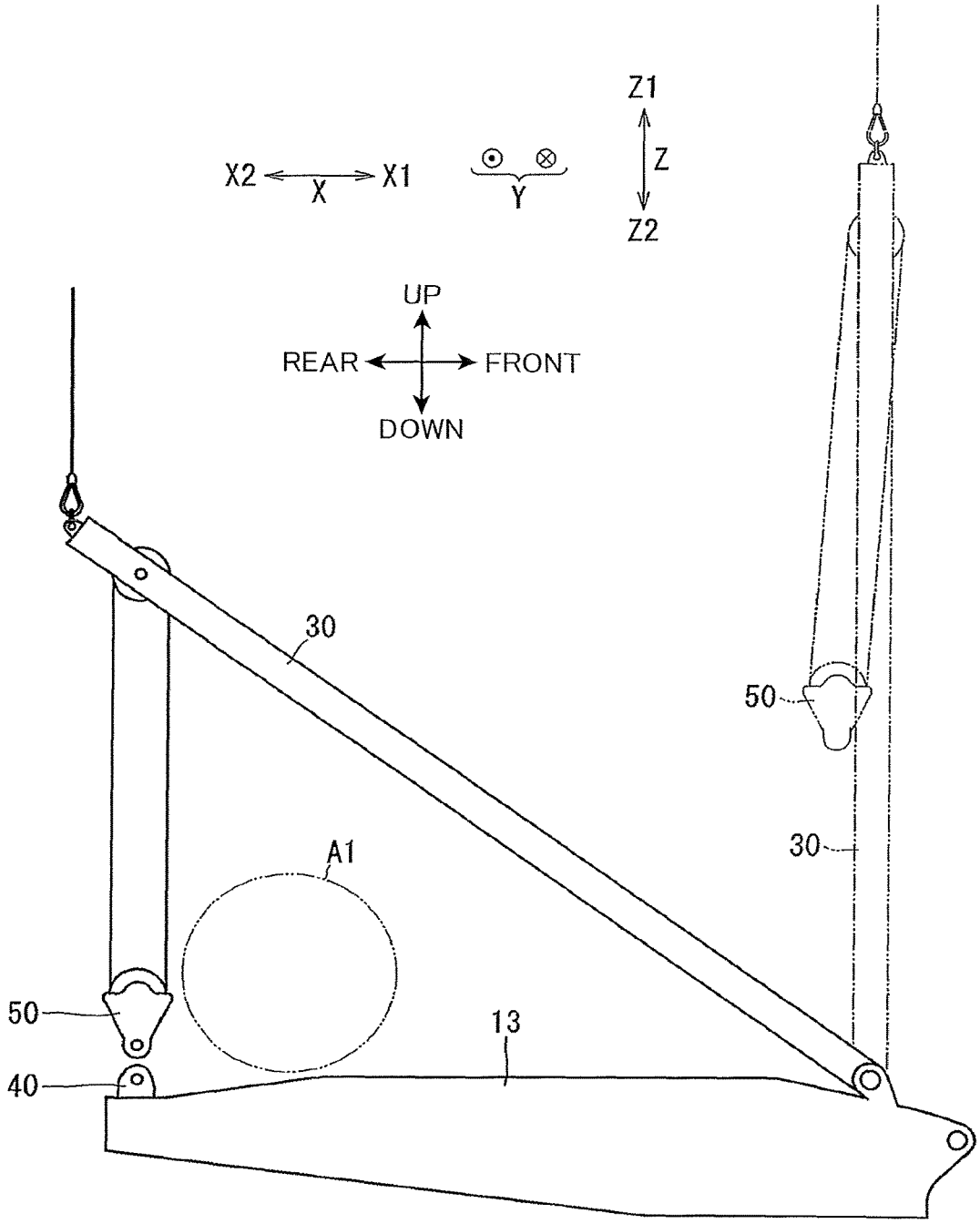
FIG. 9 is a side view illustrating a derricking apparatus for comparison with the derricking apparatus of the construction machine according to the embodiment of the present invention.

FIG. 9 is a side view illustrating a derricking apparatus for comparison with the derricking apparatus 20 according to the present embodiment. This comparative apparatus which disallows a lower spreader 50 to reach an attachment position where the lower spreader 50 is attachable to and detachable from a lower spreader retainer 40 when a mast 30 is lowered to lie in the lowered state has the following problem. In the derricking apparatus illustrated in FIG. 9, after the mast 30 is attached to a crane main body 13, the lower spreader 50 is hanged downward from the mast 30 (see the alternate long and two short dashed lines shown in FIG. 9), and an operator is then required to manually perform position adjustment of a pin hole of the lower spreader 50 and a pin hole of the lower spreader retainer 40 while the mast 30 is being lowered. This position adjustment is time-consuming. Furthermore, the operator should perform the operation in a limited space A1 which lies in front of the lower spreader 50 under the mast 30 over the crane main body 13. Hence, it is difficult to attach the lower spreader 50 to the lower spreader retainer 40. In contrast, the present embodiment can avoid the aforementioned problem, since the operator is not required to manually perform the position adjustment of the body-side hole 40S and the spreader side-hole 51S for the lower spreader attachment pin P1 (see FIG. 6).

Figure 10:
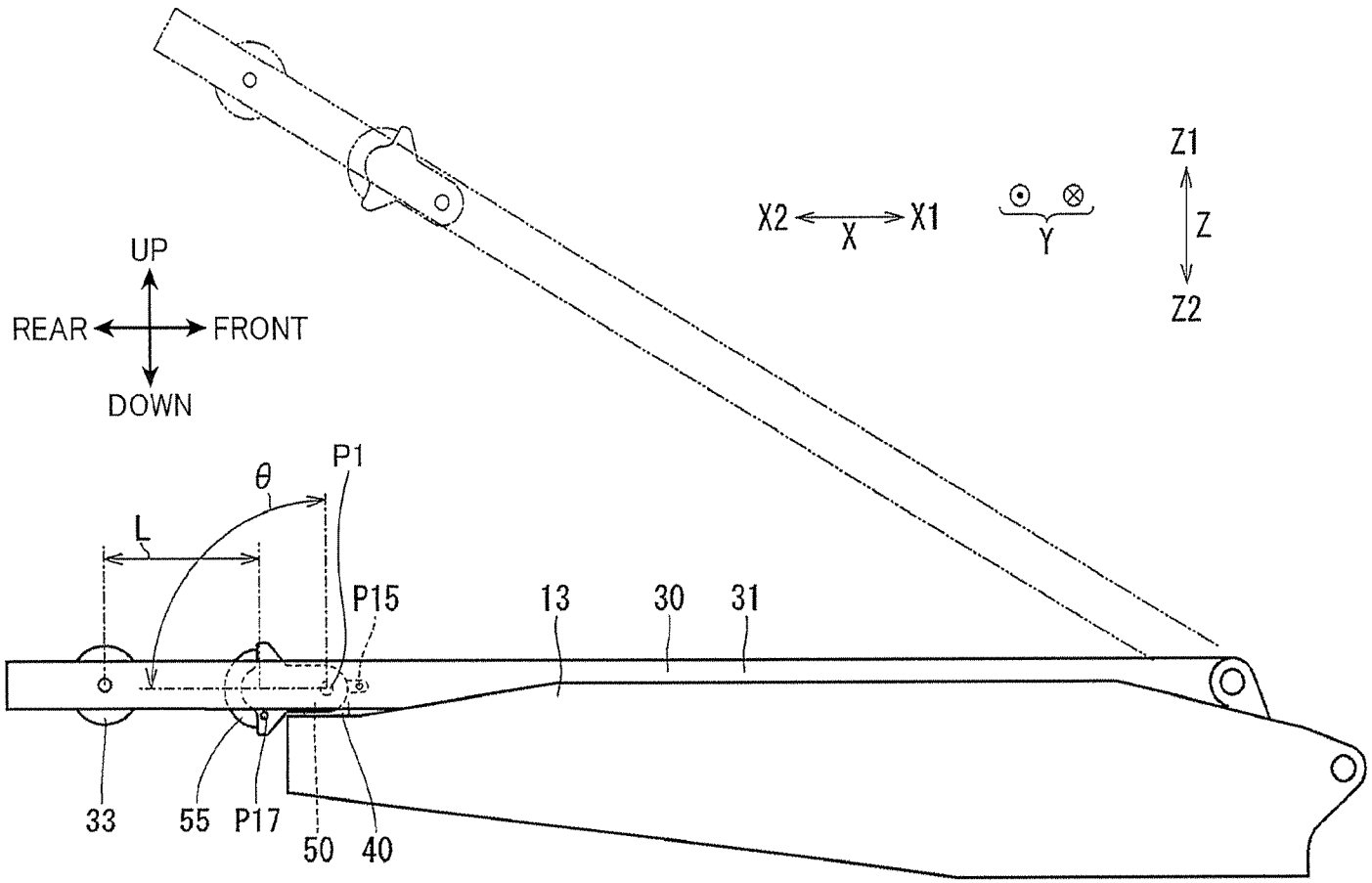
FIG. 10 is a side view illustrating a derricking apparatus according to another embodiment of the present invention.

FIG. 10 is a side view illustrating a derricking apparatus according to another embodiment of the present invention. A lower spreader 50 of the derricking apparatus illustrated in FIG. 10 is attachable to and detachable from a mast 30 and a lower spreader retainer 40. Further, when the mast 30 lies in a lowered state, and the lower spreader 50 is in an accommodation state by being accommodated by the mast 30, a position of a body-side hole 40S (FIG. 5) of the lower spreader 40 laterally agrees with a position of a spreader side hole 51S (FIG. 5) of the lower spreader 50. This configuration allows a lower spreader attachment pin P1 to be engageable through the body-side hole 40S and the spreader side hole 51S. In this embodiment, however, a rotational axis of a lower sheave 55 and a rotational axis of an upper sheave 33 come into the same height (vertical position) in the lowered and accommodated state. In this state, it is difficult to ensure a space between two main members 31 to perform placement and displacement of a pin 17 (corresponding to the lower sheave-side connection pin P7 shown in FIG. 6). In this embodiment, the lower spreader 50 has a tilt angle θ of approximately 90°. Moreover, the lower sheave 55 is placed in the space between the two main members 31. Thus, it is difficult to arrange the pin 17 at a laterally inside position (see FIG. 4) of the main member 31 between the main member 31 and the lower sheave 55. Accordingly, the pin 17 is arranged at a position near a bottom of the main member 31.

In this embodiment, however, it will be seen that, when an operator gets on the crane main body 13 shown in FIG. 10 and performs placement and displacement of the pin P17 thereover, there are the following problems, for example. In this arrangement, an operation way may be adopted that, for example, the operator performs placement and displacement of the pin P17 in a state of striding over the main member 31 (see FIG. 4) at a position near the lower spreader holder 40 toward the laterally outside of the main member 31 in the rear of the crane main body 13. This operation way will be apparently seen to be relatively difficult. In contrast, in the former embodiment shown in FIG. 6, the lower sheave 55 is located at a lower position than the main member 31, which accordingly can ensure a space between the two main members 31 to enable placement and displacement of the lower sheave-side connection pin P7. Thus, after getting on the crane main body 13, an operator can easily perform placement and displacement of the lower sheave-side connection pin P7 thereover.

In the embodiment shown in FIG. 10, another operation way may be adopted that an operator performs placement and displacement of the pin P17 without getting on the crane main body 13. For example, the operator may place or displace the pin P17 from the underside of the lower spreader 50 while staying on a stepladder placed on the ground. However, the operator is required to get on the crane main body 13 to place and displace a pin P15 (corresponding to the frame-side connection pin P5 shown in FIG. 6). In other words, the operator should move between the top of the main body 13 and the ground in order to perform placement and displacement of the pins P17 and 15. This movement will be seen to be time-consuming. Otherwise, one or more additional operators will be required in order to avoid the above-described operator's movement. In this aspect, the former embodiment shown in FIG. 6 has a relatively advantageous effect that, after getting on the crane main body 13, a single operator can perform placement and displacement of the lower sheave-side connection pin P7 and the frame-side connection pin P5 thereover. Hence, the pin placement and displacement can be accomplished in a simplified manner.

As shown in FIG. 10, further, when the mast 30 lies in the lowered state, the tilt angle θ of the lower spreader 50 is approximately 90° and a rotational axis of the upper sheave 33 is at substantially the same height (vertical position) as the axis of the lower spreader attachment pin P1. In other words, a distance L between the rotational axis of the upper sheave 33 and the rotational axis of the lower sheave 55 becomes a minimum when only the tilt angle θ is changed to reach approximately 90°, unless the distance between the axis of the upper sheave 33 and the axis of the lower spreader attachment pin P1 changes. As described above, the distance L is required to ensure a predetermined extent or greater. However, in this embodiment, there is a likelihood that the distance L is smaller than the predetermined extent when the tilt angle θ is approximately 90°. To avoid this problem in the embodiment shown in FIG. 10, it may be appreciated to increase the length of the mast 30 in the mast axial directions to ensure a sufficient distance L. However, this will involve an expansion of the size of the mast 30, and an increase in the weight of the mast 30. It will be seen that the former embodiment shown in FIG. 6, which permits the tilt angle θ to be larger than 90° as shown in FIG. 3, can facilitate ensuring the distance L to be equal to or greater than the predetermined extent.

The derricking apparatus 20 according to the present invention brings about advantageous effects described below. The derricking apparatus 20 includes the mast 30, the lower spreader retainer 40, the lower spreader 50, and the connector 60. The mast 30 is tiltably attached to the crane main body 13, and operable to longitudinally lie over the crane main body 13 (in the frontward and rearward directions) to be in the lowered state. The lower spreader retainer 40 is fixedly attached to the crane main body 13. The lower spreader 50 is detachably attachable to the mast 30 and the lower spreader retainer 40. The connector 60 connects the mast 30 and the lower spreader 50 with each other to thereby permit the lower spreader 50 to be put in the accommodation state where the lower spreader 50 is attached to the mast 30. The accommodation state means a state where the lower spreader 50 is accommodated by or attached to the mast 30. When the mast 30 lies in the lowered state and the lower spreader 50 is in the accommodation state, the connector 60 connects the mast 30 and the lower spreader 50 with each other to allow the lower spreader 50 to reach the predetermined attachment position where the lower spreader 50 is attachable to and detachable from the lower spreader retainer 40. Therefore, when the lower spreader 50 is attached to the lower spreader retainer 40, the mast 30 accommodating the lowering spreader 50 is merely placed in the lowered state, which consequently allows the lower spreader 50 to automatically reach the predetermined attachment position to the lower spreader retainer 40. Thus, the operator is not required to manually perform the position adjustment of the lower spreader 50 and the lower spreader retainer 40. This configuration enables an easier attachment of the lower spreader 50 to the machine main body 13.

Moreover, the lower spreader 50 includes the holder frame 51 and the lower sheave 55. The holder frame 51 is detachably attachable to the lower spreader 40. The lower sheave 55 is rotatably attached to the holder frame 51. Further, when the mast 30 lies in the lowered state and the lower spreader 50 is in the accommodation state, the connector 60 connects the mast 30 and the lower spreader 50 with each other so that the position of the spreader side-hole 51S of the holder frame 51 and the position of the body-side hole 40S of the lower spreader retainer 40 agree with each other, and the lower spreader attachment pin P1 is engageable therethrough. Hence, the operator is not required to manually perform the position adjustment of the spreader-side hole 51S in the lower spreader 50 and the body-side hole 40S of the lower spreader retainer 40. This configuration enables an easier attachment of the lower spreader 50 to the machine main body 13.

Furthermore, the mast 30 includes the main member 31 and the upper sheave 33. The upper sheave 33 is rotatably attached to the main member 31. The wire rope W (see FIG. 2) runs through the upper sheave 33 and the lower sheave 55 therebetween. When the mast 30 lies in the lowered state and the lower spreader 50 is in the accommodation state, the connector 60 connects the mast 30 and the lower spreader 50 with each other so that the rotational axis of the lower sheave 55 is located at a lower position than the rotational axis of the upper sheave 33. Hence, this configuration can facilitate ensuring the sufficient distance L between the rotational axis of the lower sheave 55 and the rotational axis of the upper sheave 33 in comparison with the embodiment where the rotational axis of the lower sheave 55 and the rotational axis of the upper sheave 33 come into the same vertical position in the lowered state. Accordingly, this configuration can eliminate the necessity of increasing the length of the mast 30 in the mast axial directions in order to ensure the sufficient distance L.

The connector 60 includes the lower sheave-side connecting member 83. The lower sheave-side connecting member 83 connects the mast 30 and the specified portion of the lower spreader 50 with each other, the specified portion being closer to the lower sheave 55 than the gravity center of the lower spreader 50. Further, when the mast 30 lies in the lowered state and the lower spreader 50 is in the accommodation state, the connection position of the lower sheave-side connecting member 83 to the mast 30 (i.e., the position of the lower sheave-side connection pin P7 and the mast distal end-side connecting member 73) is higher than the lower sheave 55. This configuration can facilitate connecting the lower sheave-side connecting member 83 and the mast 30 with each other, and disconnecting these elements from each other (i.e., placing and displacing the lower sheave-side connection pin P7) without being interrupted by the lower sheave 55.

Besides, as shown in FIG. 6, the lower spreader 50 includes the lower sheave shaft 57 which rotatably supports the lower sheave 55 with respect to the holder frame 51. Also, the lower sheave-side connecting member 83 is connected to the lower sheave center shaft 57. In this manner, the lower sheave center shaft 57 is utilized to connect the lower spreader 50 and the mast 30 with each other. Accordingly, this configuration can suppress an increase in the number of components required to connect the lower spreader 50 and the mast 30 with each other, and an increase in the weight resulting from the increased number of components.

Moreover, the lower sheave-side connecting member 83 is rotatably connected to the lower sheave center shaft 57. This configuration can ensure smooth connection position adjustment of the lower sheave-side connecting member 83 to the mast 30 (i.e., to the position of the lower sheave-side connection pin P7).

Furthermore, the lower sheave-side connecting member 83 includes the shaft link part 83*a* and the extension link part 83*b*. The shaft link part 83*a* is rotatably connected to the lower sheave center shaft 57. The extension link part 83*b* is pivotally connected to the shaft link part 82, and to the mast-side connecting member 73 when the lower spreader 50 is in the accommodation state. This configuration can ensure smooth connection position adjustment of the lower sheave-side connecting member 83 to the mast 30 (i.e., to the position of the lower sheave-side connection pin P7).

This advantageous effect will be understandable in comparison with a configuration where an extension link part 83*b* and a shaft link part 83*a* are not pivotally connected with each other, in other words, a pin hole for a lower sheave-side connection pin P7 cannot move other than along an arc having a center at an axis of a lower shave center shaft 57, in the lateral view. In this configuration, the pin hole for the lower sheave-side connection pin P7 can move other than along an are having a center at an axis of the lower shave center shaft 57. Accordingly, the lower spreader 50 can be easily accommodated by or attached to the mast 30.

Additionally, the connector 60 includes the frame-side connecting member 81. The frame-side connecting member 81 connects the holder frame 51 and the mast 30 with each other in the accommodation state of the lower spreader 50. The frame-side connecting member 81 is arranged on one side of the gravity center of the lower spreader 50 that is opposite to the other side where the lower sheave 55 lies. In this configuration, the lower sheave-side connecting member 83 connects the mast 30 and the specified portion that is closer to the lower sheave 55 than the gravity center of the lower spreader 50 with each other. Further, the frame-side connecting member 81 connects the mast 30 and the another specified portion that is closer to the lower spreader proximal end than the gravity center of the lower spreader 50. Accordingly, the combination of the frame-side connecting member 81 and the lower sheave-side connecting member 83 can ensure stable accommodation of the lower spreader 50 by the mast 30, or attachment thereof to the mast 30.

Furthermore, according to the present invention, various changes may be made in the shape and arrangement of a part constituting the derricking apparatus 20. Also, a part constituting the derricking apparatus 20 may be omitted. The number of parts constituting the derricking apparatus 20 may be changed. Further, the parts may be attached or connected to each other in a direct way or indirect way.

In the embodiment shown in FIG. 6, the lower sheave-side connecting member 83 is attached to the lower sheave center shaft 57. However, it may be appreciated to attach the lower sheave-side connecting member 83 to the sheave outer plate 51*e* shown in FIG. 3 or other member, for example. In the embodiment shown in FIG. 6, the lower sheave-side connecting member 83 is a combination of the two parts, i.e., the shaft link part 83*a* and the extension link part 83*b*. However, it may be appreciated to make a lower sheave-side connecting member 83 by a single part, or by three or more parts.

In the embodiment shown in FIG. 1, the boom 15 is connected with the derricking apparatus 20. However, it may be appreciated to connect a tiltable member other than the boom 15, for example, an additional mast, provided between the mast 30 and the boom 15 to the derricking apparatus 20. In this case, the derricking apparatus 20 raises and lowers the boom 15 by raising and lowering the additional mast.

This application is based on Japanese Patent applications No. 2016-105598 and No. 2017-078957 filed in Japan Patent Office on May 26, 2016 and Apr. 12, 2017, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A derricking apparatus which is to be mounted on a construction machine including a machine main body and a tiltable member tiltably supported to the machine main body, and is adapted for raising and lowering the tiltable member, the derricking apparatus comprising:

a mast attached to the machine main body tiltably about a predetermined axis, linked with the tiltable member, and operable to lie over the machine main body;

a lower spreader;

a lower spreader retainer fixedly attached to the machine main body, and adapted for retaining the lower spreader linked with the mast via a wire rope; and a connector for connecting the mast and the lower spreader with each other so that the mast holds the lower spreader in a tilt state wherein the mast tilts upward about the predetermined axis, wherein the connector connects the mast and the lower spreader with each other at a position that allows the lower spreader retainer to retain the lower spreader when the mast holding the lower spreader by the connector is lowered to lie over the machine main body from the tilt state.

2. A derricking apparatus according to claim 1, wherein the lower spreader includes:

a holder frame detachably attachable to the lower spreader retainer; and a lower sheave rotatably attached to the holder frame, and having a circumferential surface on which the wire rope is wound, the lower spreader retainer is formed with a body-side hole, and the holder frame of the lower spreader is formed with a spreader-side hole, the derricking apparatus further comprising:

a connection pin engageable through the body-side hole and the spreader-side hole to keep the lower spreader retainer retaining the lower spreader, wherein the spreader-side hole and the body-side hole of the lower spreader retainer agree with each other in an insertion direction of the connection pin when the mast holding the lower spreader is lowered to lie over the machine main body.

3. A derricking apparatus which is to be mounted on a construction machine including a machine main body and a tiltable member tiltably supported to the machine main body, and is adapted for raising and lowering the tiltable member, the derricking apparatus comprising:

a mast attached to the machine main body tiltably about a predetermined axis, linked with the tiltable member, and operable to lie over the machine main body;

a lower spreader;

a lower spreader retainer fixedly attached to the machine main body, and adapted for retaining the lower spreader linked with the mast via a wire rope; and a connector for connecting the mast and the lower spreader with each other so that the mast holds the lower spreader, wherein the connector connects the mast and the lower spreader with each other at a position that allows the lower spreader retainer to retain the lower spreader when the mast holding the lower spreader is lowered to lie over the machine main body, wherein the lower spreader includes:

a holder frame detachably attachable to the lower spreader retainer; and a lower sheave rotatably attached to the holder frame, and having a circumferential surface on which the wire rope is wound, the lower spreader retainer is formed with a body-side hole, and the holder frame of the lower spreader is formed with a spreader-side hole, the derricking apparatus further comprising;

a connection pin engageable through the body-side hole and the spreader-side hole to keep the lower spreader retainer retaining the lower spreader, wherein the spreader-side hole and the body-side hole of the lower spreader retainer agree with each other in an insertion direction of the connection pin when the mast holding the lower spreader is lowered to lie over the machine main body, the mast includes:

a main member tiltably attached to the machine main body; and an upper sheave rotatably attached to the main member, and having a circumferential surface on which the wire rope is wound, and a rotational axis of the lower sheave is located at a lower position than a rotational axis of the upper sheave when the mast holding the lower spreader is lowered to lie over the machine main body.

4. A derricking apparatus which is to be mounted on a construction machine including a machine main body and a tiltable member tiltably supported to the machine main body, and is adapted for raising and lowering the tiltable member, the derricking apparatus comprising:

a mast attached to the machine main body tiltably about a predetermined axis, linked with a tiltable member, and operable to lie over the machine main body;

a lower spreader;

a lower spreader retainer fixedly attached to the machine main body, and adapted for retaining the lower spreader linked with the mast via a wire rope; and a connector for connecting the mast and the lower spreader with each other so that the mast holds the lower spreader, wherein the connector connects the mast and the lower spreader with each other at a position that allows the lower spreader retainer to retain the lower spreader when the mast holding the lower spreader is lowered to lie over the machine main body, wherein the lower spreader includes:

a holder frame detachably attachable to the lower spreader retainer; and a lower sheave rotatably attached to the holder frame, and having a circumferential surface on which the wire rope is wound, the lower spreader retainer is formed with a body-side hole, and the holder frame of the lower spreader is formed with a spreader-side hole, the derricking apparatus further comprising:

a connection pin engageable through the body-side hole and the spreader-side hole to keep the lower spreader retainer retaining the lower spreader, wherein the spreader-side hole and the body-side hole of the lower spreader retainer agree with each other in an insertion direction of the connection pin when the mast holding the lower spreader is lowered to lie over the machine main body, the connector includes:

a lower-sheave-side connecting member which connects the mast and a specified portion of the lower spreader with each other so that the mast holds the lower spreader, the specified portion being closer to the lower sheave than a gravity center of the lower spreader; and a mast-side connecting member provided on the mast, and connected with the lower-sheave-side connecting member, the mast-side connecting member being located at a higher position than the lower sheave when the mast holding the lower spreader is lowered to lie over the machine main body.

5. A derricking apparatus according to claim 4, wherein the lower spreader has a lower sheave center shaft supported by the holder frame, and rotatably supporting the lower sheave, and the lower sheave-side connecting member is connected to the lower sheave center shaft.

6. A derricking apparatus according to claim 5, wherein the lower sheave-side connecting member is rotatably connected to the lower sheave center shaft.

7. A derricking apparatus according to claim 6, wherein the lower sheave-side connecting member includes:

a shaft link part rotatably connected to the lower sheave center shaft; and an extension link part pivotally connected to the shaft link part and connectable to the mast-side connecting member.

8. A derricking apparatus according to claim 4, wherein the connector further includes a frame-side connecting member which connects the mast and another specified portion of the lower spreader with each other so that the mast holds the lower spreader, the another specified portion being on one side of the gravity center of the lower spreader that is opposite to the other side where the lower sheave lies.

* * * * *